US011574588B2

(12) United States Patent
Li et al.

(10) Patent No.: US 11,574,588 B2
(45) Date of Patent: Feb. 7, 2023

(54) PIXEL DRIVING CIRCUIT AND DRIVING METHOD THEREOF AND DISPLAY DEVICE

(71) Applicants: Chongqing BOE Optoelectronics Technology Co., Ltd., Chongqing (CN); BOE TECHNOLOGY GROUP CO., LTD., Beijing (CN)

(72) Inventors: Shaoru Li, Beijing (CN); Rui Wang, Beijing (CN); Ni Yang, Beijing (CN)

(73) Assignees: CHONGQING BOE OPTOELECTRONICS TECHNOLOGY CO., LTD., Chongqing (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/280,874

(22) PCT Filed: Jun. 15, 2020

(86) PCT No.: PCT/CN2020/096092
§ 371 (c)(1),
(2) Date: Mar. 27, 2021

(87) PCT Pub. No.: WO2020/253646
PCT Pub. Date: Dec. 24, 2020

(65) Prior Publication Data

US 2021/0407390 A1 Dec. 30, 2021

(30) Foreign Application Priority Data

Jun. 17, 2019 (CN) ..... 201910522270.1

(51) Int. Cl.
*G09G 3/32* (2016.01)
*G09G 3/3208* (2016.01)

(52) U.S. Cl.
CPC ..... *G09G 3/3208* (2013.01); *G09G 2300/0426* (2013.01); *G09G 2300/0809* (2013.01);
(Continued)

(58) Field of Classification Search
CPC ..... G09G 3/3208; G09G 2300/0426; G09G 2300/0809; G09G 2310/0286; G09G 2310/061
See application file for complete search history.

(56) References Cited

U.S. PATENT DOCUMENTS 10,381,426 B2 8/2019 Ka et al.
2014/0027728 A1 1/2014 Yoon et al.
(Continued)

FOREIGN PATENT DOCUMENTS

CN 103208254 A 7/2013
CN 103544917 A 1/2014
(Continued)

OTHER PUBLICATIONS

China Patent Office, First Office Action dated May 7, 2020, for corresponding Chinese application 201910522270.1.

*Primary Examiner* — Lin Li
(74) *Attorney, Agent, or Firm* — Houtteman Law LLC

(57) ABSTRACT

The present disclosure provides a pixel driving circuit including a driving transistor, a capacitor and a light emitting device, and further includes: a first reset module; a data writing module; a threshold compensation module including a compensation transistor; a light emitting control module configured to disconnect the first power terminal from the first electrode of the driving transistor and disconnect the second electrode of the driving transistor from the light emitting device in the data writing phase and the reset phase; and to enable the first power terminal and the first electrode
(Continued)

of the driving transistor to be electrically connected to each other and enable the second electrode of the driving transistor and the light emitting device to be electrically connected to each other in a light emitting phase; the compensation transistor is an oxide transistor, and the driving transistor is a low temperature poly-silicon transistor.

12 Claims, 5 Drawing Sheets

(52) U.S. Cl.
CPC ..... *G09G 2310/0286* (2013.01); *G09G 2310/061* (2013.01)

(56) References Cited

U.S. PATENT DOCUMENTS

| | | | | |
|---|---|---|---|---|
| 2015/0049126 | A1 | 2/2015 | Jung | |
| 2016/0071458 | A1 | 3/2016 | Tan et al. | |
| 2018/0130412 | A1 | 5/2018 | Zhang et al. | |
| 2018/0166021 | A1 | 6/2018 | Xi et al. | |
| 2018/0190204 | A1 | 7/2018 | Shin et al. | |
| 2019/0088200 | A1 | 3/2019 | Woo et al. | |
| 2019/0096327 | A1* | 3/2019 | Peng | G09G 3/3233 |
| 2019/0103055 | A1* | 4/2019 | Gao | G09G 3/3233 |
| 2019/0304371 | A1* | 10/2019 | Li | G09G 3/3233 |
| 2019/0347987 | A1* | 11/2019 | Zhao | G09G 3/3233 |
| 2021/0201776 | A1 | 7/2021 | Yuan et al. | |
| 2021/0312866 | A1* | 10/2021 | Fan | G09G 3/3258 |

FOREIGN PATENT DOCUMENTS

| | | | | | |
|---|---|---|---|---|---|
| CN | 103578417 | A | | 2/2014 | |
| CN | 104821150 | A | | 8/2015 | |
| CN | 106297645 | A | | 1/2017 | |
| CN | 107342044 | A | | 11/2017 | |
| CN | 107342049 | A | | 11/2017 | |
| CN | 107452334 | A | * | 12/2017 | G09G 3/32 |
| CN | 107481675 | A | * | 12/2017 | G09G 3/3291 |
| CN | 107564468 | A | | 1/2018 | |
| CN | 107610652 | A | * | 1/2018 | G09G 3/32 |
| CN | 108281116 | A | | 7/2018 | |
| CN | 108376534 | A | | 8/2018 | |
| CN | 108648691 | A | * | 10/2018 | G09G 3/32 |
| CN | 108806610 | A | | 11/2018 | |
| CN | 109215569 | A | | 1/2019 | |
| CN | 110223636 | A | | 9/2019 | |
| CN | 110264946 | A | * | 9/2019 | G09G 3/32 |
| CN | 110277060 | A | | 9/2019 | |
| CN | 111243504 | A | * | 6/2020 | G09G 3/32 |
| JP | 2019061286 | A | | 4/2019 | |
| KR | 20190033683 | A | | 4/2019 | |

* cited by examiner

PIXEL DRIVING CIRCUIT AND DRIVING METHOD THEREOF AND DISPLAY DEVICE

CROSS REFERENCE TO RELATED APPLICATIONS

The present application claims the priority of the Chinese Patent Application No. 201910522270.1 filed on Jun. 17, 2019, the content of which is incorporated herein by reference in its entirety.

TECHNICAL FIELD

The present disclosure relates to the field of display technology, in particular to a pixel driving circuit and a driving method thereof, and a display device.

BACKGROUND

In an Organic Light Emitting Diode (OLED) display panel, threshold voltages of driving transistors in respective pixel units may differ from each other due to a manufacturing process, and the threshold voltages of the driving transistors may also drift due to an influence of factors such as temperature. Therefore, the difference in threshold voltages of the respective driving transistors may also cause light emitting luminance of light emitting devices to be inconsistent, thereby causing display of the display panel to be non-uniform.

SUMMARY

The present disclosure provides a pixel driving circuit and a driving method thereof, and a display device.

The present disclosure provides a pixel driving circuit including a driving transistor, a capacitor and a light emitting device, wherein two terminals of the capacitor are respectively coupled to a first power terminal and a gate electrode of the driving transistor, the pixel driving circuit further includes:

a first reset module configured to transmit a signal from an initialization voltage terminal to the gate electrode of the driving transistor in a reset phase;

a data writing module configured to write a data signal from a data writing terminal into a first electrode of the driving transistor in a data writing phase;

a threshold compensation module including a compensation transistor, the compensation transistor configured to connect a second electrode and the gate electrode of the driving transistor in the data writing phase;

a light emitting control module configured to disconnect the first power terminal from the first electrode of the driving transistor and disconnect the second electrode of the driving transistor from the light emitting device in the data writing phase and the reset phase; and to connect the first power terminal and the first electrode of the driving transistor and connect the second electrode of the driving transistor and the light emitting device in a light emitting phase;

wherein the compensation transistor is an oxide transistor, and the driving transistor is a low temperature poly-silicon transistor.

Optionally, the pixel driving circuit further includes: a second reset module coupled to a first reset terminal, the initialization voltage terminal and a first terminal of the light emitting device, and configured to transmit the signal from the initialization voltage terminal to the first terminal of the light emitting device in response to a control of a first level signal provided by the first reset terminal in the reset phase.

Optionally, the data writing module includes: a writing transistor, wherein a gate electrode of the writing transistor is coupled to a first scanning terminal, a first electrode of the writing transistor is coupled to the data writing terminal, and a second electrode of the writing transistor is coupled to the first electrode of the driving transistor.

Optionally, a gate electrode of the compensation transistor is coupled to a second scanning terminal, a first electrode of the compensation transistor is coupled to the second electrode of the driving transistor, and a second electrode of the compensation transistor is coupled to the gate electrode of the driving transistor.

Optionally, the first reset module includes a first reset transistor, wherein a gate electrode of the first reset transistor is coupled to a second reset terminal, a first electrode of the first reset transistor is coupled to the gate electrode of the driving transistor, and a second electrode of the first reset transistor is coupled to the initialization voltage terminal;

the first reset transistor is an oxide transistor.

Optionally, the light emitting control module includes: a control unit and a gating unit;

the control unit is coupled to the second reset terminal, the second scanning terminal and the gating unit, and configured to transmit a second level signal provided by the second reset terminal to the gating unit in response to the second level signal in the reset phase; to transmit a second level signal provided by the second scanning terminal to the gating unit in response to the second level signal in the data writing phase; and to transmit a first level signal provided by the second reset terminal to the gating unit in response to the first level signal in the light emitting phase;

the gating unit is configured to connect the first power terminal and the first electrode of the driving transistor and connect the second electrode of the driving transistor and the light emitting device under the control of the first level signal; and to disconnect the first power terminal from the first electrode of the driving transistor and disconnect the second electrode of the driving transistor from the light emitting device under the control of the second level signal.

Optionally, the control unit includes: a first control transistor, a second control transistor, a third control transistor, and a fourth control transistor;

a gate electrode and a first electrode of the first control transistor are both coupled to the second scanning terminal, and a second electrode of the first control transistor is coupled to the gating unit;

a gate electrode and a first electrode of the second control transistor are both coupled to the second reset terminal, and a second electrode of the second control transistor is coupled to the gating unit;

a gate electrode and a first electrode of the third control transistor are both coupled to the second scanning terminal, and a second electrode of the third control transistor is coupled to a first electrode of the fourth control transistor; and a gate electrode of the fourth control transistor is coupled to the second reset terminal, and a second electrode of the fourth control transistor is coupled to the gating unit.

Optionally, the gating unit includes: a first gating transistor and a second gating transistor, a gate electrode of the first gating transistor is coupled to the control unit, a first electrode of the first gating transistor is coupled to the first power terminal, and a second electrode of the first gating transistor is coupled to the first electrode of the driving transistor;

a gate electrode of the second gating transistor is coupled to the control unit, a first electrode of the second gating transistor is coupled to the second electrode of the driving transistor, and a second electrode of the second gating transistor is coupled to the light emitting device.

Optionally, the threshold compensation module further includes: a compensation control transistor, wherein a gate electrode of the compensation control transistor is coupled to the first scanning terminal, a first electrode of the compensation control transistor is coupled to a light emitting control terminal, and a second electrode of the compensation control transistor is coupled to a gate electrode of the compensation transistor;

a first electrode of the compensation transistor is coupled to the second electrode of the driving transistor, and a second electrode of the compensation transistor is coupled to the gate electrode of the driving transistor.

Optionally, the first reset module includes: a second reset transistor and a third reset transistor, a gate electrode of the third reset transistor is coupled to the first reset terminal, a first electrode of the third reset transistor is coupled to the light emitting control terminal, and a second electrode of the third reset transistor is coupled to a gate electrode of the second reset transistor; a first electrode of the second reset transistor is coupled to the gate electrode of the driving transistor, and a second electrode of the second reset transistor is coupled to the initialization voltage terminal;

the second reset transistor is an oxide transistor.

Optionally, the light emitting control module includes: a third gating transistor and a fourth gating transistor, a gate electrode of the third gating transistor and a gate electrode of the fourth gating transistor are both coupled to the light emitting control terminal, a first electrode of the third gating transistor is coupled to the first power terminal, and a second electrode of the third gating transistor is coupled to the first electrode of the driving transistor; and a first electrode of the fourth gating transistor is coupled to the second electrode of the driving transistor, and a second electrode of the fourth gating transistor is coupled to the first terminal of the light emitting device.

Optionally, the second reset module includes: a fourth reset transistor, wherein a gate electrode of the fourth reset transistor is coupled to the first reset terminal, a first electrode of the fourth reset transistor is coupled to the initialization voltage terminal, and a second electrode of the fourth reset transistor is coupled to the first terminal of the light emitting device.

Accordingly, the present disclosure also provides a driving method for the pixel driving circuit as described above, including steps of:

in a reset phase, transmitting, by the first reset module, a signal from the initialization voltage terminal to the gate electrode of the driving transistor, so as to control the driving transistor to be turned on; by the light emitting control module, disconnecting the first power terminal from the first electrode of the driving transistor and disconnecting the second electrode of the driving transistor from the light emitting device;

in the data writing phase, writing, by the data writing module, a data signal from the data writing terminal into the first electrode of the driving transistor; enabling, by the compensation transistor, the second electrode and the gate electrode of the driving transistor to be electrically connected to each other; by the light emitting control module, disconnecting the first power terminal from the first electrode of the driving transistor and disconnecting the second electrode of the driving transistor from the light emitting device;

in the light emitting phase, by the light emitting control module, enabling the first power terminal and the first electrode of the driving transistor to be electrically connected to each other and enabling the second electrode of the driving transistor and the light emitting device to be electrically connected to each other.

Optionally, the driving method specifically includes steps of:

in the reset phase, providing the first level signal to the first reset terminal and the second scanning terminal, and providing the second level signal to the first scanning terminal and the second reset terminal;

in the data writing phase, providing the second level signal to the first reset terminal and the second scanning terminal, and providing the first level signal to the first scanning terminal and the second reset terminal;

in the light emitting phase, providing the second level signal to the first reset terminal and the first scanning terminal, and providing the first level signal to the second reset terminal and the second scanning terminal.

Optionally, the driving method specifically includes steps of:

in the reset phase, providing the first level signal to the first reset terminal and providing a second level signal to the light emitting control terminal and the first scanning terminal;

in the data writing phase, providing the second level signal to the light emitting control terminal and the first reset terminal, and providing the first level signal to the first scanning terminal;

in the light emitting phase, providing the first level signal to the light emitting control terminal, and providing the second level signal to the first reset terminal and the first scanning terminal.

Accordingly, the present disclosure also provides a display device including the pixel driving circuit as described above.

In an embodiment, the display device includes a display panel, the display panel includes a display area and a peripheral area on the periphery of the display area; the display area includes a plurality of pixel units arranged in a plurality of rows and a plurality of columns, the pixel driving circuit as described above is in each of the pixel units, wherein the light emitting control module includes: a control unit and a gating unit; a first shift register and a second shift register are in the peripheral area on the periphery of the display area, the first shift register includes a plurality of stages of first shift register units, the second shift register includes a plurality of stages of second shift register units, and the first shift register unit at each stage and the second shift register unit at each stage each correspond to one row of pixel units; the plurality of stages of first shift register units sequentially output low level signals, and the plurality of stages of second shift register units sequentially output high level signals; the first reset terminal of the pixel driving circuit in the $n^{th}$ row of the pixel units is coupled to an output of the first shift register unit at the $(n-1)^{th}$ stage, and the first scanning terminal of the pixel driving circuit in the $n^{th}$ row of the pixel units is coupled to an output of the first shift register unit at the $n^{th}$ stage; the second reset terminal of the pixel driving circuit in the $n^{th}$ row of the pixel units is coupled to an output of the second shift register unit at the $(n-1)^{th}$ stage, and the second scanning terminal of the pixel driving circuit in the $n^{th}$ row of the pixel units is coupled to an output of the second shift register unit at the $n^{th}$ stage; the first reset terminal of the pixel driving circuit in the $1^{st}$ row of pixel units is coupled to an output of the first shift register unit at the $N^{th}$ stage, the second reset terminal of the pixel driving circuit in the $1^{st}$ row of pixel units is coupled to an output of the second shift register unit at the $N^{th}$ stage, where N is the row number of the pixel units, and n is an integer larger than 1 and not larger than N.

In an embodiment, the display device includes a display panel, the display panel includes a display area and a peripheral area on the periphery of the display area; the display area includes a plurality of pixel units arranged in a plurality of rows and a plurality of columns, the pixel driving circuit as described above is in each of the pixel units, wherein the light emitting control module includes: a third gating transistor and a fourth gating transistor; a first shift register and a third shift register are in the peripheral area on the periphery of the display area, the first shift register includes a plurality of stages of first shift register units, the third shift register includes a plurality of stages of third shift register units, the first shift register unit at each stage and the third shift register unit at each stage each correspond to one row of pixel units; the first reset terminal of the pixel driving circuit in the $n^{th}$ row of the pixel units is coupled to an output of the first shift register unit at the $(n-1)^{th}$ stage, and the first scanning terminal of the pixel driving circuit in the $n^{th}$ row of the pixel units is coupled to an output of the first shift register unit at the $n^{th}$ stage; the light emitting control terminal of the pixel driving circuit in the $n^{th}$ row of the pixel units is coupled to an output of the third shift register unit at the $n^{th}$ stage; the third shift register unit at the $n^{th}$ stage outputs high level signals in the reset phase and the data writing stage of the pixel driving circuit in the $n^{th}$ row of the pixel units; the first reset terminal of the pixel driving circuit in the $1^{st}$ row of pixel units is coupled to an output of the first shift register unit at the $N^{th}$ stage, where N is the row number of the pixel units, and n is an integer greater than 1 and not greater than N.

BRIEF DESCRIPTION OF DRAWINGS

Drawings, which are included to provide a further understanding of the present disclosure, constitute a part of this specification, serve to explain the present disclosure together with the following detailed description, but do not constitute a limitation to the present disclosure. In the drawings.

DETAIL DESCRIPTION OF EMBODIMENTS

The detailed description of the embodiments of the present disclosure will be described detailed below with a reference to the accompanying drawings. It should be understood that the detailed description of the embodiments described here is only used to illustrate and explain the present disclosure, not to limit the present disclosure.

Figure 1:
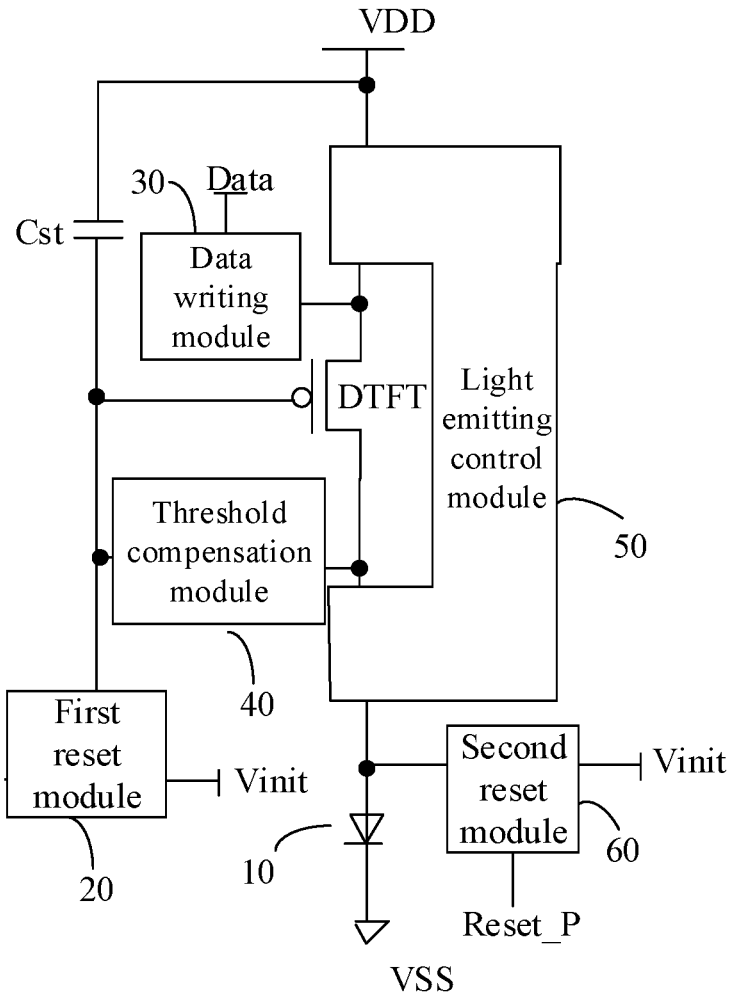
FIG. 1 is a schematic diagram of a pixel driving circuit according to an embodiment of the present disclosure.

FIG. 1 is a schematic diagram of a pixel driving circuit according to an embodiment of the present disclosure. As shown in FIG. 1, the pixel driving circuit includes: a driving transistor DTFT, a capacitor Cst, a light emitting device 10, a first reset module 20, a data writing module 30, a threshold compensation module 40, and a light emitting control module 50.

An operating phase for the pixel driving circuit includes a reset phase, a data writing phase and a light emitting phase.

Both terminals of the capacitor Cst are respectively coupled to a gate electrode of the driving transistor DTFT and a first power terminal VDD. The first reset module 20 is coupled to the gate electrode of the driving transistor DTFT and an initialization voltage terminal Vinit, and is configured to transmit a signal from the initialization voltage terminal Vinit to the gate electrode of the driving transistor DTFT in the reset phase.

The data writing module 30 is coupled to a data writing terminal Data and a first electrode of the driving transistor DTFT, and is configured to write a data signal of the data writing terminal Data into the first electrode of the driving transistor DTFT in the data writing phase.

Figure 2:
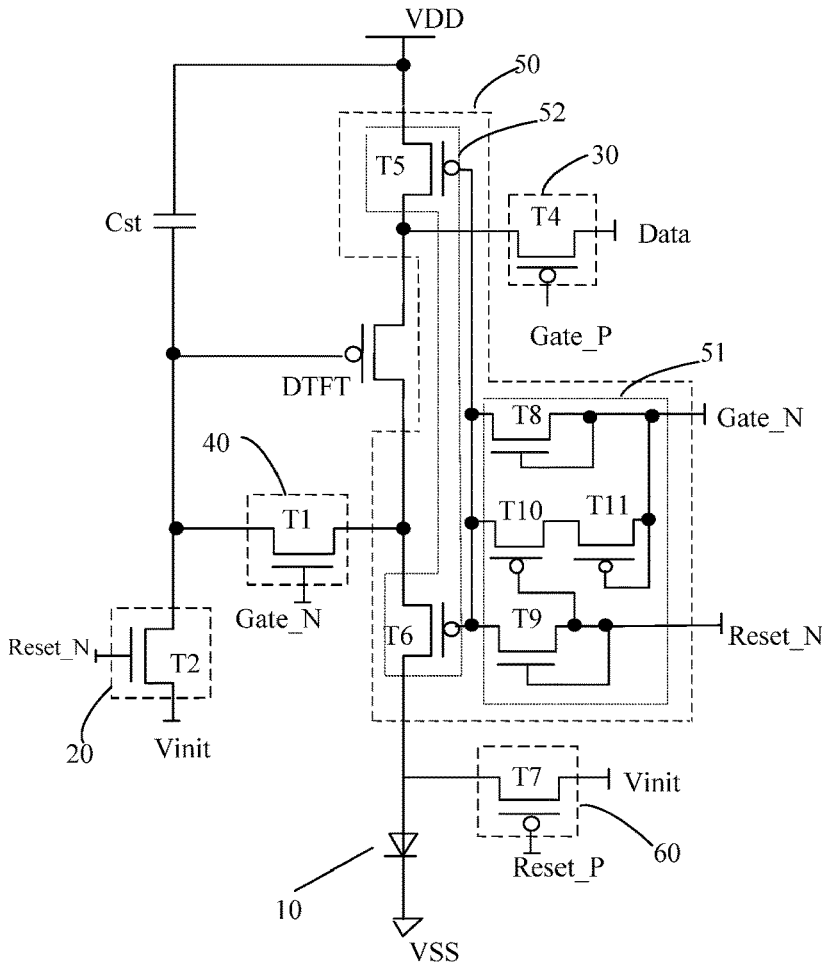
FIG. 2 is a schematic diagram of a pixel driving circuit according to an embodiment of the present disclosure.

The threshold compensation module 40 includes a compensation transistor T1, a first electrode of the compensation transistor T1 is coupled to a second electrode of the driving transistor DTFT, and a second electrode of the compensation transistor T1 is coupled to the gate electrode of the driving transistor DTFT; the compensation transistor T1 is configured to connect (conduct) the second electrode and the gate electrode of the driving transistor DTFT in the data writing phase, as shown in FIG. 2.

The light emitting control module 50 is coupled to the first power terminal VDD, the first electrode of the driving transistor DTFT, the second electrode of the driving transistor DTFT, and a first terminal of the light emitting device 10, and the light emitting control module 50 is configured to disconnect the first power terminal VDD from the first electrode of the driving transistor DTFT and disconnect the second electrode of the driving transistor DTFT from the light emitting device 10 in the data writing phase and the reset phase; and connect the first power terminal VDD and the first electrode of the driving transistor DTFT and connect the second electrode of the driving transistor DTFT and the light emitting device 10 in the light emitting phase.

The compensation transistor T1 is an oxide transistor (oxide TFT); the driving transistor DTFT is a low temperature poly-silicon transistor (LTPS TFT). The oxide TFTs in the present disclosure are all N-type transistors, and the low temperature poly-silicon transistors are all P-type transistors.

A second terminal of the light emitting device 10 is coupled to a second power source terminal VSS. The first power source terminal VDD may be a high level signal terminal, and the second power source terminal VSS may be a low level signal terminal, such as a ground terminal.

In the embodiment of the present disclosure, in the data writing phase, the compensation transistor T1 connects the gate electrode and the second electrode of the driving transistor DTFT, thereby forming a path for compensating voltage of the gate electrode of the driving transistor DTFT through the second electrode of the driving transistor DTFT. Specifically, in the reset phase, the gate electrode of the driving transistor DTFT receives the signal from the initialization voltage terminal Vinit, and thereby reaches an initial voltage; in the data writing phase, data at the data writing terminal Data is written into the first electrode of the driving transistor DTFT, and the gate electrode and the second electrode of the driving transistor DTFT are in short circuit to form a diode, at this time, a data signal passes through the driving transistor DTFT and the compensating transistor T1 and flows to the gate electrode of the driving transistor DTFT, such that a potential of the gate electrode of the driving transistor DTFT reaches Vdata+Vth, where Vth is a threshold voltage of the driving transistor, and Vdata is the voltage of the data signal provided by the data writing terminal Data. In the light emitting phase, under the voltage holding effect of the capacitor Cst, the potential of the gate electrode of the driving transistor DTFT is held at Vdata+Vth; the voltage from the first power source terminal VDD generates a driving current flowing into the light emitting device 10 after passing through the light emitting control module 50 and the driving transistor DTFT. At this time, the driving current $I_{OLED}$ satisfies the following saturation current formula:

$$I_{OLED} = K(Vgs - Vth)^2 = K(Vdata + Vth - ELVDD - Vth)^2 = K(Vdata - ELVDD)^2 \quad (1)$$

where K is a coefficient related to characteristics of the driving transistor DTFT itself, Vgs is a gate-source voltage of the driving transistor DTFT, i.e., a voltage between the gate electrode and the first electrode of the driving transistor DTFT, and ELVDD is a voltage provided from the first power terminal VDD.

It can be seen that the driving current $I_{OLED}$ provided to the light emitting device 10 is not affected by the threshold voltage.

In addition, the low temperature poly-silicon transistor has the advantages of relatively large threshold voltage, small cut-in voltage, high mobility and the like, so that the driving transistor DTFT in the present disclosure can realize a low-frequency and low-power consumption driving by adopting the low temperature poly-silicon transistor; compared with the low temperature poly-silicon transistor, the oxide transistor has smaller and flat current $T_{off}$ in an off state, so when the compensating transistor T1 of the present disclosure is the oxide transistor, the leakage current in the circuit is very small, therefore, the problem of inconsistent light emitting brightness of the light emitting device 10 in the pixel driving circuit can be solved.

Further, as shown in FIG. 1, the pixel driving circuit further includes: a second reset module 60. The second reset module 60 is coupled to a first reset terminal Reset_P, the initialization voltage terminal Vinit and the first terminal of the light emitting device 10, and is configured to transmit the signal from the initialization voltage terminal Vinit to the first terminal of the light emitting device 10, in response to the control of a first level signal provided by the first reset terminal Reset_P in the reset phase, so as to initialize the potential of the first terminal of the light emitting device 10.

FIG. 2 is a schematic diagram of a pixel driving circuit according to an embodiment of the present disclosure, where the pixel driving circuit is a specific implementation of the structure in FIG. 1. As shown in FIG. 2, the data writing module 30 includes: a writing transistor T4. A gate electrode of the writing transistor T4 is coupled to a first scanning terminal Gate_P, a first electrode of the writing transistor T4 is coupled to the data writing terminal Data, and a second electrode of the writing transistor T4 is coupled to the first electrode of the driving transistor DTFT. The writing transistor T4 is a low temperature poly-silicon transistor.

The threshold compensation module 40 includes the compensation transistor T1, a gate electrode of the compensation transistor T1 is coupled to a second scanning terminal Gate_N, the first electrode of the compensation transistor T1 is coupled to the second electrode of the driving transistor DTFT, and the second electrode of the compensation transistor T1 is coupled to the gate electrode of the driving transistor DTFT.

The first reset module 20 includes: a first reset transistor T2. A gate electrode of the first reset transistor T2 is coupled to a second reset terminal Reset_N, a first electrode of the first reset transistor T2 is coupled to the gate electrode of the driving transistor DTFT, and a second electrode of the first reset transistor T2 is coupled to the initialization voltage terminal Vinit. The first reset transistor T2 is an oxide transistor. That is, in the present embodiment, the transistors controlling the potential of the gate electrode of the driving transistor DTFT each employ an oxide transistor, to reduce the leakage current.

The second reset module 60 includes: a fourth reset transistor T7. A gate electrode of the fourth reset transistor T7 is coupled to the first reset terminal Reset_P, a first electrode of the fourth reset transistor T7 is coupled to the initialization voltage terminal Vinit, and a second electrode of the fourth reset transistor T7 is coupled to the first terminal of the light emitting device 10. The fourth reset transistor T7 is a low temperature poly-silicon transistor.

Figure 7:
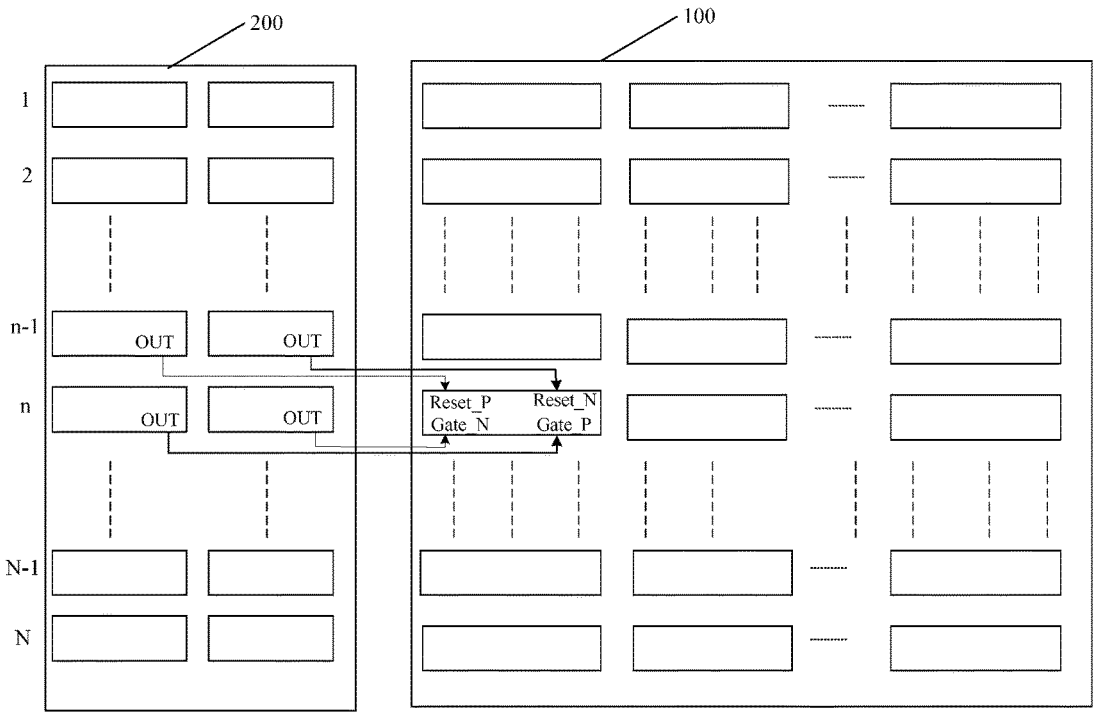
FIG. 7 is a schematic diagram of a structure of a display device according to an embodiment of the present disclosure.

The first level signal provided by the first reset terminal Reset_P in the reset phase is a signal for controlling the fourth reset transistor T7 to be turned on. A second level signal provided by the second reset terminal Reset_N in the reset phase is a signal for controlling the first reset transistor T2 to be turned on. The first scanning terminal Gate_P provides a signal for controlling the writing transistor T4 to be turned on in the data writing phase, and the second scanning terminal Gate_N provides a signal for controlling the compensation transistor T1 to be turned on in the data writing phase. In the embodiment, the first reset transistor T2 and the compensation transistor T1 are oxide transistors, and the fourth reset transistor T7 and the writing transistor T4 are low temperature poly-silicon transistors, that is, the first level signal is a low level signal, and the second level signal is a high level signal. Therefore, the first reset terminal Reset_P and the first scanning terminal Gate_P may be coupled to shift register units in two adjacent stages of a same shift register, and a plurality of stages of shift register units (shift register units at multiple stages) of the shift register sequentially output low level signals, so that the first reset terminal Reset_P and the first scanning terminal Gate_P sequentially receive low level signals in two adjacent phases. In addition, the second reset terminal Reset_N and the second scanning terminal Gate_N may be coupled to shift register units in two adjacent stages of a same shift register, and a plurality of stages of shift register units of the shift register sequentially output high level signals, so that the second reset terminal Reset_N and the second scanning terminal Gate_N sequentially receive high level signals in two adjacent phases, as shown in FIG. 7.

The light emitting control module 50 includes: a control unit 51 and a gating unit 52.

The control unit 51 is coupled to the second reset terminal Reset_N, the second scanning terminal Gate_N and the gating unit 52, and is configured to transmit a second level signal provided by the second reset terminal Reset_N to the gating unit 52 in response to the second level signal in the reset phase; and transmit a second level signal provided by the second scanning terminal Gate_N to the gating unit 52 in response to the second level signal in the data writing phase; and transmit a first level signal provided by the second reset terminal Reset_N to the gating unit 52 in response to the first level signal in the light emitting phase.

The gating unit 52 is configured to enable the first power terminal VDD and the first electrode of the driving transistor DTFT to be electrically connected to each other, and enable the second electrode of the driving transistor DTFT and the light emitting device 10 to be electrically connected to each other under the control of the first level signal; and disconnect the first power terminal VDD from the first electrode of the driving transistor DTFT and disconnect the second electrode of the driving transistor DTFT from the light emitting device 10 under the control of the second level signal.

Specifically, as shown in FIG. 2, the control unit 51 includes: a first control transistor T8, a second control transistor T9, a third control transistor T11, and a fourth control transistor T10. The first control transistor T8 and the second control transistor T9 are oxide transistors; the third control transistor T11 and the fourth control transistor T10 are low temperature poly-silicon transistors.

A gate electrode and a first electrode of the first control transistor T8 are both coupled to the second scanning terminal Gate_N, and a second electrode of the first control transistor T8 is coupled to the gating unit 52.

A gate electrode and a first electrode of the second control transistor T9 are both coupled to the second Reset terminal Reset_N, and a second electrode of the second control transistor T9 is coupled to the gating unit 52.

A gate electrode and a first electrode of the third control transistor T11 are both coupled to the second scanning terminal Gate_N, and a second electrode of the third control transistor T11 is coupled to a first electrode of the fourth control transistor T10. A gate electrode of the fourth control transistor T10 is coupled to the second reset terminal Reset_N, and a second electrode of the fourth control transistor T10 is coupled to the gating unit 52.

The gating unit 52 specifically includes: a first gating transistor T5 and a second gating transistor T6. The first and second gating transistors T5 and T6 are both low temperature poly-silicon transistors.

A gate electrode of the first gating transistor T5 is coupled to the control unit, in particular to the second electrode of the second control transistor T9, the second electrode of the fourth control transistor T10 and the second electrode of the first control transistor T8; a first electrode of the first gating transistor T5 is coupled to the first power source terminal VDD, and a second electrode of the first gating transistor T5 is coupled to the first electrode of the driving transistor DTFT.

A gate electrode of the second gating transistor T6 is coupled to the control unit 51, in particular to the second electrode of the second control transistor T9, the second electrode of the fourth control transistor T10 and the second electrode of the first control transistor T8; a first electrode of the second gating transistor T6 is coupled to the second electrode of the driving transistor DTFT, and a second electrode of the second gating transistor T6 is coupled to the light emitting device 10.

Figure 3:
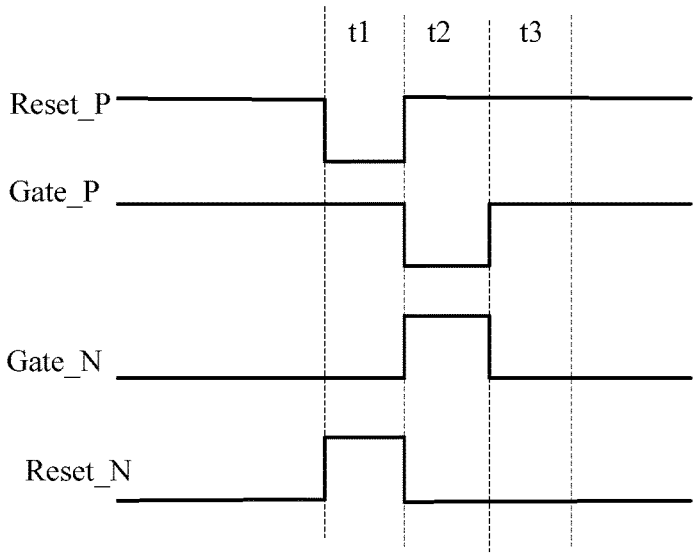
FIG. 3 is a timing diagram of signals applied to some signal terminals in the pixel driving circuit shown in FIG. 2.

FIG. 3 is a timing diagram of some signal terminals in the pixel driving circuit shown in FIG. 2. As shown in FIG. 3, in the reset phase t1, the first reset terminal Reset_P and the second scanning terminal Gate_N provide a low level signal, and the second reset terminal Reset_N and the first scanning terminal Gate_P provide a high level signal.

At this time, the low level signal provided by the first reset terminal Reset_P controls the fourth reset transistor T7 to be turned on, the high level signal provided by the second reset terminal Reset_N controls the first reset transistor T2 to be turned on, and the initial voltage from the initialization voltage terminal Vinit is transmitted to the gate electrode of the driving transistor DTFT and the first terminal of the light emitting device 10. Meanwhile, the high level signal provided by the second reset terminal Reset_N controls the second control transistor T9 to be turned on, thereby transmitting the high level signal from the second reset terminal Reset_N to the gate electrode of the first gating transistor T5 and the gate electrode of the second gating transistor T6, so that the first gating transistor T5 and the second gating transistor T6 are turned off. In addition, the low level signal provided by the second scanning terminal Gate_N controls the first control transistor T8 to be turned off, and the high level signal provided by the second reset terminal Reset_N controls the fourth control transistor T10 to be turned off.

In the data writing phase t2, the first reset terminal Reset_P and the second scanning terminal Gate_N provide a high level signal, and the second reset terminal Reset_N and the first scanning terminal Gate_P provide a low level signal.

At this time, since the second scanning terminal Gate_N provides the high level signal, the first control transistor T8 is turned on, the third control transistor T11 is turned off, and since the second reset terminal Reset_N provides the low level signal, the second control transistor T9 is turned off, and the fourth control transistor T10 is turned on. At this time, the high level signal from the second scanning terminal Gate_N is transmitted to the gate electrode of the first gating transistor T5 and the gate electrode of the second gating transistor T6 to control the first gating transistor T5 and the second gating transistor T6 to be turned off. Meanwhile, the compensation transistor T1 is turned on under the control of the high level signal provided by the second scanning terminal Gate_N, the writing transistor T4 is turned on under the control of the low level signal of the first scanning terminal Gate_P, the data signal at the data writing terminal Data is transmitted to the gate electrode of the driving transistor DTFT through the compensation transistor T1 and the writing transistor T4, and the potential of the gate electrode of the driving transistor DTFT reaches Vdata+Vth.

In the light emitting phase t3, the first reset terminal Reset_P and the first scanning terminal Gate_P each provide the high level signal, and the second reset terminal Reset_N and the second scanning terminal Gate_N each provide the low level signal.

At this time, since the second reset terminal Reset_N provides the low level signal, the second control transistor T9 is turned off, and the fourth control transistor T10 is turned on. Since the second scanning terminal Gate_N provides the low level signal, the first control transistor T8 is turned off, the third control transistor T11 is turned on, and the low level signal from the second scanning terminal Gate_N is transmitted to the gate electrodes of the first and second gating transistors T5 and T6, thereby turning on the first and second gating transistors T5 and T6. Under the voltage holding effect of the capacitor Cst, the potential of the gate electrode of the driving transistor DTFT is held at Vdata+Vth, the driving transistor DTFT remains turned on, and the driving current flows into the light emitting device 10 to cause the light emitting device 10 to emit light. A magnitude of the driving current is defined in the above formula (1). In this phase, except for the first gating transistor T5, the second gating transistor T6 and the driving transistor DTFT, other transistors are all turned off.

In the present embodiment, the first gating transistor T5 and the second gating transistor T6 can be controlled by the control unit 51 in cooperation with the first scanning terminal Gate_P, the first reset terminal Reset_P, the second scanning terminal Gate_N and the second reset terminal Reset_N to be turned off in the reset phase and the data writing phase, and to be turned on in the light emitting phase; as shown above, the signals of the first reset terminal Reset_P and the first scanning terminal Gate_P may be provided by the same shift register, and the signals of the second reset terminal Reset_N and the second scanning terminal Gate_N may be provided by the same shift register, so that only two shift registers need to be disposed at the periphery of a display area, and it is not necessary to separately provide a shift register for the first gating transistor T5 and the second gating transistor T6 to provide the light emitting control signal, thereby reducing peripheral wiring and facilitating implementation of a narrow frame.

Figure 4:
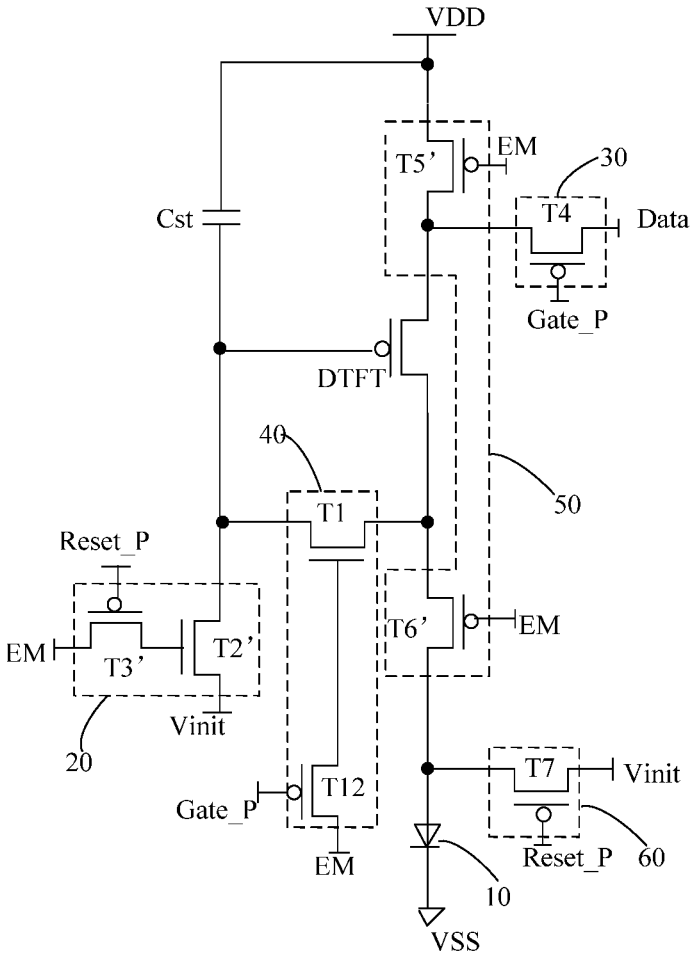
FIG. 4 is a schematic diagram of a pixel driving circuit according to an embodiment of the present disclosure.

FIG. 4 is a schematic diagram of a pixel driving circuit according to an embodiment of the present disclosure, where the pixel driving circuit is another specific implementation of the structure in FIG. 1. As shown in FIG. 4, the data writing module 30 includes: the writing transistor T4. The gate electrode of the writing transistor T4 is coupled to the first scanning terminal Gate_P, the first electrode of the writing transistor T4 is coupled to the data writing terminal Data, and the second electrode of the writing transistor T4 is coupled to the first electrode of the driving transistor DTFT. The writing transistor T4 is the low temperature poly-silicon transistor.

The compensation module 40 includes: the compensation transistor T1 and a compensation control transistor T12. A gate electrode of the compensation control transistor T12 is coupled to the first scanning terminal Gate_P, a first electrode of the compensation control transistor T12 is coupled to the light emitting control terminal EM, and a second electrode of the compensation control transistor T12 is coupled to the gate electrode of the compensation transistor T1. The first electrode of the compensating transistor T1 is coupled to the second electrode of the driving transistor DTFT, and the second electrode of the compensating transistor T1 is coupled to the gate electrode of the driving transistor DTFT.

The first reset module 20 includes: a second reset transistor T2' and a third reset transistor T3'. A gate electrode of the third reset transistor T3' is coupled to the first reset terminal Reset_P, a first electrode of the third reset transistor T3' is coupled to the light emitting control terminal EM, and a second electrode of the third reset transistor T3' is coupled to a gate electrode of the second reset transistor T2'. A first electrode of the second reset transistor T2' is coupled to the gate electrode of the driving transistor DTFT, and a second electrode of the second reset transistor T2' is coupled to the initialization voltage terminal Vinit.

The second reset module includes: the fourth reset transistor T7. The gate electrode of the fourth reset transistor T7 is coupled to the first reset terminal Reset_P, the first electrode of the fourth reset transistor T7 is coupled to the initialization voltage terminal Vinit, and the second electrode of the fourth reset transistor T7 is coupled to the first terminal of the light emitting device 10.

The light emitting control module 50 includes: a third gating transistor T5' and a fourth gating transistor T6'. A gate electrode of the third gating transistor T5' and a gate electrode of the fourth gating transistor T6' are both coupled to the light emitting control terminal EM, a first electrode of the third gating transistor T5' is coupled to the first power source terminal VDD, and a second electrode of the third gating transistor T5' is coupled to the first electrode of the driving transistor DTFT. A first electrode of the fourth gating transistor T6' is coupled to the second electrode of the driving transistor DTFT, and a second electrode of the fourth gating transistor T6' is coupled to the first terminal of the light emitting device 10.

In the present embodiment, the transistors (i.e., the second reset transistor T2' and the compensation transistor T1) directly coupled to the gate electrode of the driving transistor DTFT are oxide transistors, and the remaining transistors are low temperature poly-silicon transistors.

The first level signal provided by the first reset terminal Reset_P in the reset phase is a signal for controlling the fourth reset transistor T7 to be turned on, and the signal provided by the first scanning terminal Gate_P in the data writing phase is a signal for controlling the writing transistor T4 to be turned on. In the embodiment, the fourth reset transistor T7 is a P-type transistor, i.e. the first level signal is the low level signal, and the first scanning terminal Gate_P provides the low level signal in the data writing phase.

Figure 5:
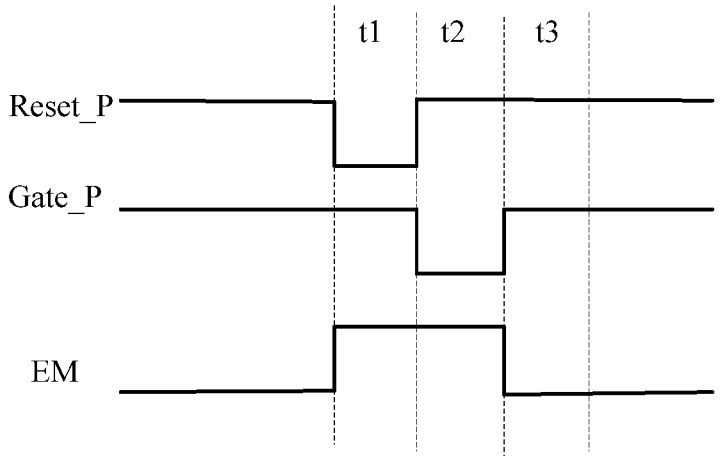
FIG. 5 is a timing diagram of signals applied to some signal terminals in the pixel driving circuit shown in FIG. 4.

FIG. 5 is a timing diagram of some signal terminals in the pixel driving circuit shown in FIG. 4. In conjunction with FIGS. 4 and 5, in the reset phase t1, the light emitting control terminal EM and the first scanning terminal Gate_P both provide the high level signal, and the first reset terminal Reset_P provides the low level signal.

At this time, the third reset transistor T3' and the fourth reset transistor T7 are turned on under the control of the low level signal from the first reset terminal Reset_P, so that the high level signal from the light emitting control terminal EM is transmitted to the gate electrode of the second reset transistor T2' to control the second reset transistor T2' to be turned on, and thus, the initialization signal from the initialization voltage terminal Vinit is transmitted to the gate electrode of the driving transistor DTFT through the second reset transistor T2' and to the first terminal of the light emitting device 10 through the fourth reset transistor T7. In addition, since the light emitting control terminal EM provides the high level signal, both the third gating transistor T5' and the fourth gating transistor T6' are turned off, and no driving current is generated.

In the data writing phase t2, the light emitting control terminal EM and the first reset terminal Reset_P both provide the high level signal, and the first scanning terminal Gate_P provides the low level signal.

At this time, both the third gating transistor T5' and the fourth gating transistor T6' remain off. Since the first reset terminal Reset_P provides the high level signal, the third reset transistor T3', the second reset transistor T2', and the fourth transistor are turned off. Since the first scanning terminal Gate_P provides the low level signal, the writing transistor T4 and the compensation control transistor T12 are turned on, so that the high level signal of the light emitting control terminal EM is transmitted to the gate electrode of the compensation transistor T1 through the compensation control transistor T12, so that the compensation transistor T1 is turned on. At this time, the data signal from the data writing terminal Data is transmitted to the gate electrode of the driving transistor DTFT through the compensation transistor T1 and the writing transistor T4, and the potential of the gate electrode of the driving transistor DTFT reaches Vdata+Vth.

In the light emitting phase t3, the first reset terminal Reset_P and the first scanning terminal Gate_P both provide the high level signal, and the light emitting control terminal EM provides the low level signal.

At this time, since the first reset terminal Reset_P provides the high level signal, the third reset transistor T3', the second reset transistor T2', and the writing transistor T4 are turned off. Also, since the first scanning terminal Gate_P provides the high level signal, the writing transistor T4 and the compensation control transistor T12 are turned off, thereby causing the compensation transistor T1 to be turned off. Meanwhile, the third gating transistor T5' and the fourth gating transistor T6' are both turned on under the control of the low level signal provided by the light emitting control terminal EM. Under the voltage holding effect of the capacitor Cst, the potential of the gate electrode of the driving transistor DTFT is held at Vdata+Vth, the driving transistor DTFT remains on, and the driving current flows into the light emitting device 10 to cause the light emitting device 10 to emit light, the magnitude of the driving current is defined in the above formula (1).

As in the embodiments shown in FIGS. 2 and 3, the signals of the first reset terminal Reset_P and the first scanning terminal Gate_P may be provided by the same shift register. In addition, in the present embodiment, by providing the third reset transistor T3' and the compensation control transistor T12, and in cooperation with the signal from the light emitting control terminal EM, the third reset transistor T3' can be controlled to be turned on in the reset phase and the compensation transistor T1 can be controlled to be turned on in the data writing phase. Therefore, at the periphery of the display area, only two shift registers (one of the two shift registers is used for providing the low level signal for the first reset terminal Reset_P and the first scanning terminal Gate_P in each row of pixels, and the other is used for providing the high level signal for the light emitting control terminal EM in each row of pixels) are needed to be arranged, and it is not necessary to separately provide a shift register to control the N-type transistors in the pixel driving circuit, thereby reducing peripheral wiring and facilitating implementation of a narrow frame.

It can be seen that in the pixel driving circuits provided in the second embodiment shown in FIGS. 2 and 3 and the embodiments shown in FIGS. 4 and 5 of the present disclosure, although the N-type transistor and the P-type transistor are provided, only two shift registers are required to provide the control signal at the periphery of the display area, and it is not necessary to provide three shift registers to control the N-type transistor, the P-type transistor, and the third gating transistor T5'/the fourth gating transistor T6', respectively, thereby reducing peripheral wiring and facilitating implementation of a narrow frame.

Figure 6:
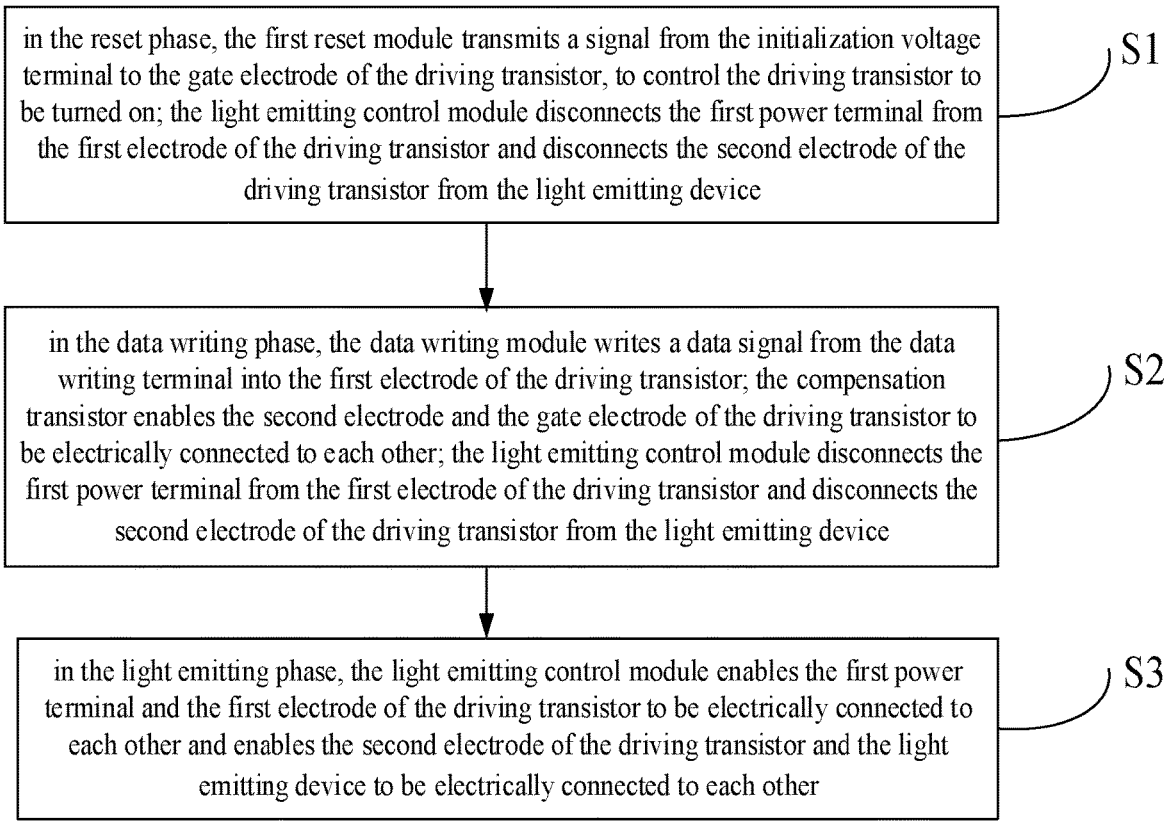
FIG. 6 is a flowchart of a driving method for a pixel driving circuit according to an embodiment of the present disclosure.

The present disclosure further provides a driving method for the pixel driving circuit, as shown in FIG. 6, including steps of:

S1: in the reset phase, the first reset module transmits a signal from the initialization voltage terminal to the gate electrode of the driving transistor, so as to control the driving transistor to be turned on; the light emitting control module disconnects the first power terminal from the first electrode of the driving transistor and disconnects the second electrode of the driving transistor from the light emitting device.

S2: in the data writing phase, the data writing module writes a data signal from the data writing terminal into the first electrode of the driving transistor; the compensation transistor connects the second electrode and the gate electrode of the driving transistor. The light emitting control module disconnects the first power terminal from the first electrode of the driving transistor and disconnects the second electrode of the driving transistor from the light emitting device.

S3: in the light emitting phase, the light emitting control module connects the first power terminal and the first electrode of the driving transistor and connects the second electrode of the driving transistor and the light emitting device.

When the pixel driving circuit adopts the structure in the embodiment shown in FIG. 2, the driving method specifically includes steps of:

In the reset phase, the first level signal is provided to the first reset terminal and the second scanning terminal, and the second level signal is provided to the first scanning terminal and the second reset terminal.

The second level signal is the high level signal for controlling the first reset transistor and the compensation transistor to be turned on; the first level signal is the low level signal for controlling other transistors to be turned on.

In the data writing phase, the second level signal is provided to the first reset terminal and the second scanning terminal, and the first level signal is provided to the first scanning terminal and the second reset terminal.

In the light emitting phase, the second level signal is provided to the first reset terminal and the first scanning terminal, and the first level signal is provided to the second reset terminal and the second scanning terminal.

The working process of the pixel driving circuit in each phase is described above, and is not described herein again.

When the pixel driving circuit adopts the structure in the embodiment shown in FIG. 4, the driving method specifically includes steps of:

In the reset phase, the first level signal is provided to the first reset terminal, and the second level signal is provided to the light emitting control terminal and the first scanning terminal. The second level signal is the high level signal for controlling the second reset transistor and the compensation transistor to be turned on, and the first level signal is the low level signal for controlling other transistors to be turned on.

In the data writing phase, the second level signal is provided to the light emitting control terminal and the first reset terminal, and the first level signal is provided to the first scanning terminal.

In the light emitting phase, the first level signal is provided to the light emitting control terminal, and the second level signal is provided to the first reset terminal and the first scanning terminal.

The working process of the pixel driving circuit in each phase is described above, and is not described herein again.

The present disclosure further provides a display device including the pixel driving circuit according to any of the above embodiments. Specifically, the display device includes a display panel, and a display area 100 of the display panel includes a plurality of pixel units arranged in a matrix form of a plurality of rows and a plurality of columns, the pixel driving circuit is provided in each of the pixel units.

In the periphery of the display area (i.e., the peripheral area of the display area), a shift register 200 for providing a control signal to the pixel driving circuit is further provided.

When the pixel driving circuit adopts the structure shown in FIG. 2, as shown in FIG. 7, a first shift register and a second shift register are arranged on the periphery of the display area, the first shift register includes a plurality of stages of first shift register units, the second shift register includes a plurality of stages of second shift register units, and the first shift register unit at each stage and the second shift register unit at each stage correspond to one row of pixel units. The plurality of stages of first shift register units sequentially output low level signals, and the plurality of stages of second shift register units sequentially output high level signals. The first reset terminal Reset_P of the pixel driving circuit in the $n^{th}$ row of the pixel units is coupled to an output of the first shift register unit at the $(n-1)^{th}$ stage, and the first scanning terminal Gate_P of the pixel driving circuit in the $n^{th}$ row of the pixel units is coupled to the output of the first shift register unit at the $n^{th}$ stage. The second reset terminal Reset_N of the pixel driving circuit in the $n^{th}$ row of the pixel units is coupled to the output of the second shift register unit at the $(n-1)^{th}$ stage, and the second scanning terminal Gate_N of the pixel driving circuit in the $n^{th}$ row of the pixel units is coupled to the output of the second shift register unit at the $n^{th}$ stage. The first reset terminal of the pixel driving circuit in the $1^{st}$ row of pixel units is coupled to the output of the first shift register unit at the $N^{th}$ stage, the second reset terminal of the pixel driving circuit in the $1^{st}$ row of pixel units is coupled to the output of the second shift register unit at the $N^{th}$ stage, where N is the row number of the pixel units, and n is an integer larger than 1 and not larger than N.

Figure 8:
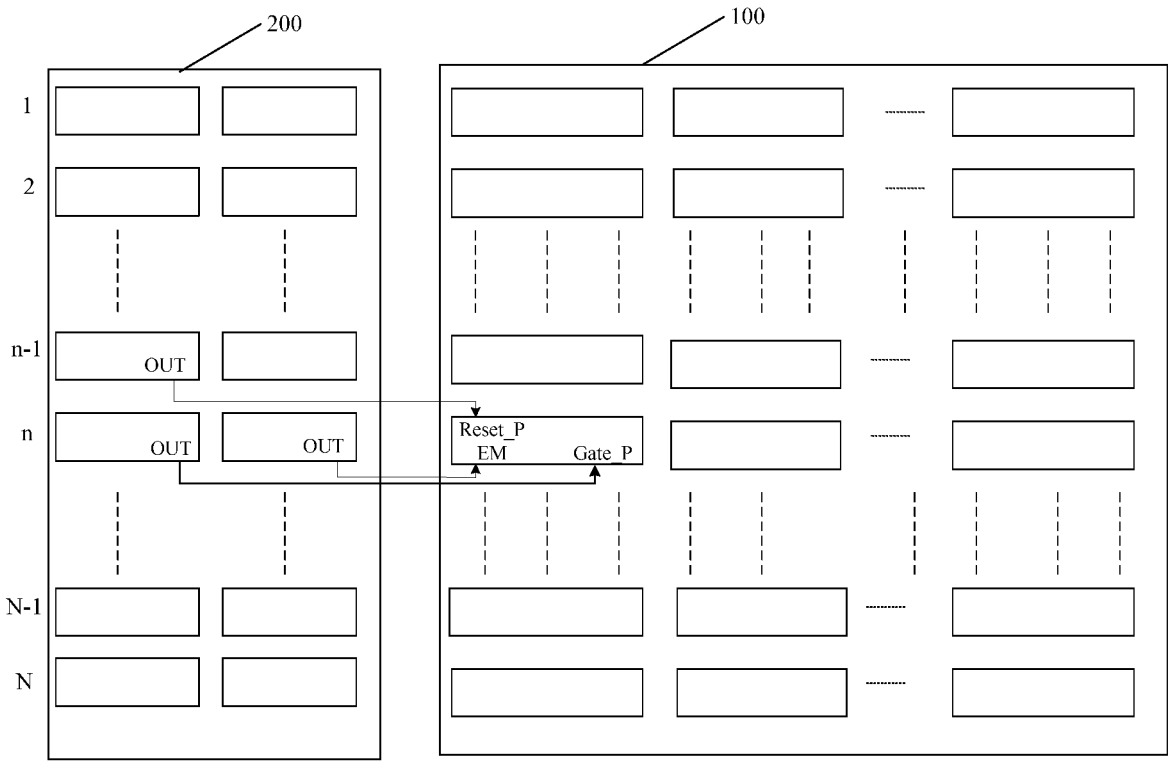
FIG. 8 is a schematic diagram of a structure of a display device according to an embodiment of the present disclosure.

When the pixel driving circuit adopts the structure shown in FIG. 4, as shown in FIG. 8, the first shift register and a third shift register are arranged on the periphery of the display area, the third shift register includes a plurality of stages of third shift register units, and the third shift register unit at each stage corresponds to one row of pixel units. The first reset terminal Reset_P of the pixel driving circuit in the $n^{th}$ row of the pixel units is coupled to the output of the first shift register unit at the $(n-1)^{th}$ stage, and the first scanning terminal Gate_P of the pixel driving circuit in the $n^{th}$ row of the pixel units is coupled to the output of the first shift register unit at the $n^{th}$ stage. The light emitting control terminal EM of the pixel driving circuit in the $n^{th}$ row of the pixel units is coupled to the output of the third shift register unit at the $n^{th}$ stage. The third shift register unit at the $n^{th}$ stage outputs high level signals in the reset phase and the data writing stage of the pixel driving circuit in the $n^{th}$ row of the pixel units. The first reset terminal of the pixel driving circuit in the $1^{st}$ row of pixel units is coupled to an output of the first shift register unit at the $N^{th}$ stage, where N is the row number of the pixel units, and n is an integer greater than 1 and not greater than N.

It will be understood that the above embodiments are merely exemplary embodiments employed to illustrate the principles of the present disclosure, but the present disclosure is not limited thereto. It will be apparent to those skilled in the art that various changes and modifications can be made therein without departing from the spirit and scope of the present disclosure, and these changes and modifications are to be considered within the scope of the present disclosure.

What is claimed is:

1. A pixel driving circuit, comprising a driving transistor, a capacitor and a light emitting device, wherein two terminals of the capacitor are respectively coupled to a first power terminal and a gate electrode of the driving transistor, wherein the pixel driving circuit further comprises:

a first reset module configured to transmit a signal from an initialization voltage terminal to the gate electrode of the driving transistor in a reset phase;

a data writing module configured to write a data signal from a data writing terminal into a first electrode of the driving transistor in a data writing phase;

a threshold compensation module comprising a compensation transistor, the compensation transistor configured to enable a second electrode and the gate electrode of the driving transistor to be electrically connected to each other in the data writing phase;

a light emitting control module configured to disconnect the first power terminal from the first electrode of the driving transistor and disconnect the second electrode of the driving transistor from the light emitting device in the data writing phase and the reset phase; and to enable the first power terminal and the first electrode of the driving transistor to be electrically connected to each other and enable the second electrode of the driving transistor and the light emitting device to be electrically connected to each other in a light emitting phase;

wherein the compensation transistor is an oxide transistor, and the driving transistor is a low temperature polysilicon transistor, wherein the light emitting control module comprises: a control unit and a gating unit;

the control unit is coupled to a second reset terminal, a second scanning terminal and the gating unit, and configured to transmit a second level signal provided by the second reset terminal to the gating unit in response to the second level signal in the reset phase; to transmit a second level signal provided by the second scanning terminal to the gating unit in response to the second level signal in the data writing phase; and to transmit a first level signal provided by the second reset terminal to the gating unit in response to the first level signal in the light emitting phase;

the gating unit is configured to enable the first power terminal and the first electrode of the driving transistor to be electrically connected to each other and enable the second electrode of the driving transistor and the light emitting device to be electrically connected to each other under control of the first level signal; and to disconnect the first power terminal from the first electrode of the driving transistor and disconnect the second electrode of the driving transistor from the light emitting device under control of the second level signal, wherein the control unit comprises: a first control transistor, a second control transistor, a third control transistor, and a fourth control transistor;

a gate electrode and a first electrode of the first control transistor are both coupled to the second scanning terminal, and a second electrode of the first control transistor is coupled to the gating unit;

a gate electrode and a first electrode of the second control transistor are both coupled to the second reset terminal, and a second electrode of the second control transistor is coupled to the gating unit;

a gate electrode and a first electrode of the third control transistor are both coupled to the second scanning terminal, and a second electrode of the third control transistor is coupled to a first electrode of the fourth control transistor; and a gate electrode of the fourth control transistor is coupled to the second reset terminal, and a second electrode of the fourth control transistor is coupled to the gating unit.

2. The pixel driving circuit according to claim 1, wherein the pixel driving circuit further comprises: a second reset module coupled to a first reset terminal, the initialization voltage terminal and a first terminal of the light emitting device, and configured to transmit the signal from the initialization voltage terminal to the first terminal of the light emitting device under control of a first level signal provided by the first reset terminal in the reset phase.

3. The pixel driving circuit according to claim 2, wherein the data writing module comprises a writing transistor; and a gate electrode of the writing transistor is coupled to a first scanning terminal, a first electrode of the writing transistor is coupled to the data writing terminal, and a second electrode of the writing transistor is coupled to the first electrode of the driving transistor.

4. The pixel driving circuit according to claim 3, wherein a gate electrode of the compensation transistor is coupled to the second scanning terminal, a first electrode of the compensation transistor is coupled to the second electrode of the driving transistor, and a second electrode of the compensation transistor is coupled to the gate electrode of the driving transistor.

5. The pixel driving circuit according to claim 4, wherein the first reset module comprises a first reset transistor;

a gate electrode of the first reset transistor is coupled to the second reset terminal, a first electrode of the first reset transistor is coupled to the gate electrode of the driving transistor, and a second electrode of the first reset transistor is coupled to the initialization voltage terminal; and the first reset transistor is an oxide transistor.

6. The pixel driving circuit according to claim 2, wherein the second reset module comprises: a fourth reset transistor, wherein a gate electrode of the fourth reset transistor is coupled to the first reset terminal, a first electrode of the fourth reset transistor is coupled to the initialization voltage terminal, and a second electrode of the fourth reset transistor is coupled to the first terminal of the light emitting device.

7. A display device, comprising a display panel, wherein the display panel comprises a display area and a peripheral area on a periphery of the display area;

the display area comprises a plurality of pixel units arranged in a plurality of rows and a plurality of columns, and each of the pixel units is provided with the pixel driving circuit according to claim 3;

a first shift register and a second shift register are in the peripheral area on the periphery of the display area, the first shift register comprises a plurality of stages of first shift register units, the second shift register comprises a plurality of stages of second shift register units, and the first shift register unit at each stage and the second shift register unit at each stage each correspond to one row of pixel units; the plurality of stages of first shift register units sequentially output low level signals, and the plurality of stages of second shift register units sequentially output high level signals; the first reset terminal of the pixel driving circuit in the $n^{th}$ row of the pixel units is coupled to an output of the first shift register unit at the $(n-1)^{th}$ stage, and the first scanning terminal of the pixel driving circuit in the $n^{th}$ row of the pixel units is coupled to an output of the first shift register unit at the $n^{th}$ stage; the second reset terminal of the pixel driving circuit in the $n^{th}$ row of the pixel units is coupled to an output of the second shift register unit at the $(n-1)^{th}$ stage, and the second scanning terminal of the pixel driving circuit in the $n^{th}$ row of the pixel units is coupled to an output of the second shift register unit at the $n^{th}$ stage; the first reset terminal of the pixel driving circuit in the $1^{st}$ row of pixel units is coupled to an output of the first shift register unit at the $N^{th}$ stage, the second reset terminal of the pixel driving circuit in the $1^{st}$ row of pixel units is coupled to an output of the second shift register unit at the $N^{th}$ stage, where N is the row number of the pixel units, and n is an integer larger than 1 and not larger than N.

8. The pixel driving circuit according to claim 1, wherein the gating unit comprises: a first gating transistor and a second gating transistor, a gate electrode of the first gating transistor is coupled to the control unit, a first electrode of the first gating transistor is coupled to the first power terminal, and a second electrode of the first gating transistor is coupled to the first electrode of the driving transistor;

a gate electrode of the second gating transistor is coupled to the control unit, a first electrode of the second gating transistor is coupled to the second electrode of the driving transistor, and a second electrode of the second gating transistor is coupled to the light emitting device.

9. A display device, comprising the pixel driving circuit according to claim 1.

10. The pixel driving circuit according to claim 1, wherein the data writing module comprises a writing transistor; and a gate electrode of the writing transistor is coupled to a first scanning terminal, a first electrode of the writing transistor is coupled to the data writing terminal, and a second electrode of the writing transistor is coupled to the first electrode of the driving transistor.

11. A driving method for driving a pixel driving circuit, wherein the pixel driving circuit comprises a driving transistor, a capacitor and a light emitting device, wherein two terminals of the capacitor are respectively coupled to a first power terminal and a gate electrode of the driving transistor, wherein the pixel driving circuit further comprises: a first reset module configured to transmit a signal from an initialization voltage terminal to the gate electrode of the driving transistor in a reset phase; a data writing module configured to write a data signal from a data writing terminal into a first electrode of the driving transistor in a data writing phase; a threshold compensation module comprising a compensation transistor, the compensation transistor configured to enable a second electrode and the gate electrode of the driving transistor to be electrically connected to each other in the data writing phase; a light emitting control module configured to disconnect the first power terminal from the first electrode of the driving transistor and disconnect the second electrode of the driving transistor from the light emitting device in the data writing phase and the reset phase; and to enable the first power terminal and the first electrode of the driving transistor to be electrically connected to each other and enable the second electrode of the driving transistor and the light emitting device to be electrically connected to each other in a light emitting phase; wherein the compensation transistor is an oxide transistor, and the driving transistor is a low temperature poly-silicon transistor, wherein the light emitting control module comprises: a control unit and a gating unit; the control unit is coupled to a second reset terminal, a second scanning terminal and the gating unit, and configured to transmit a second level signal provided by the second reset terminal to the gating unit in response to the second level signal in the reset phase; to transmit a second level signal provided by the second scanning terminal to the gating unit in response to the second level signal in the data writing phase; and to transmit a first level signal provided by the second reset terminal to the gating unit in response to the first level signal in the light emitting phase; the gating unit is configured to enable the first power terminal and the first electrode of the driving transistor to be electrically connected to each other and enable the second electrode of the driving transistor and the light emitting device to be electrically connected to each other under control of the first level signal; and to disconnect the first power terminal from the first electrode of the driving transistor and disconnect the second electrode of the driving transistor from the light emitting device under control of the second level signal, wherein the control unit comprises: a first control transistor, a second control transistor, a third control transistor, and a fourth control transistor; a gate electrode and a first electrode of the first control transistor are both coupled to the second scanning terminal, and a second electrode of the first control transistor is coupled to the gating unit; a gate electrode and a first electrode of the second control transistor are both coupled to the second reset terminal, and a second electrode of the second control transistor is coupled to the gating unit; a gate electrode and a first electrode of the third control transistor are both coupled to the second scanning terminal, and a second electrode of the third control transistor is coupled to a first electrode of the fourth control transistor; and a gate electrode of the fourth control transistor is coupled to the second reset terminal, and a second electrode of the fourth control transistor is coupled to the gating unit, the driving method comprises steps of:

in the reset phase, transmitting, by the first reset module, a signal from the initialization voltage terminal to the gate electrode of the driving transistor, so as to control the driving transistor to be turned on; by the light emitting control module, disconnecting the first power terminal from the first electrode of the driving transistor and disconnecting the second electrode of the driving transistor from the light emitting device;

in the data writing phase, writing, by the data writing module, a data signal from the data writing terminal into the first electrode of the driving transistor; enabling, by the compensation transistor, the second electrode and the gate electrode of the driving transistor to be electrically connected to each other; by the light emitting control module, disconnecting the first power terminal from the first electrode of the driving transistor and disconnecting the second electrode of the driving transistor from the light emitting device; and in the light emitting phase, by the light emitting control module, enabling the first power terminal and the first electrode of the driving transistor to be electrically connected to each other and enabling the second electrode of the driving transistor and the light emitting device to be electrically connected to each other.

12. A driving method for driving a pixel driving circuit, wherein the pixel driving circuit comprises a driving transistor, a capacitor and a light emitting device, wherein two terminals of the capacitor are respectively coupled to a first power terminal and a gate electrode of the driving transistor, wherein the pixel driving circuit further comprises: a first reset module configured to transmit a signal from an initialization voltage terminal to the gate electrode of the driving transistor in a reset phase; a data writing module configured to write a data signal from a data writing terminal into a first electrode of the driving transistor in a data writing phase; a threshold compensation module comprising a compensation transistor, the compensation transistor configured to enable a second electrode and the gate electrode of the driving transistor to be electrically connected to each other in the data writing phase; a light emitting control module configured to disconnect the first power terminal from the first electrode of the driving transistor and disconnect the second electrode of the driving transistor from the light emitting device in the data writing phase and the reset phase; and to enable the first power terminal and the first electrode of the driving transistor to be electrically connected to each other and enable the second electrode of the driving transistor and the light emitting device to be electrically connected to each other in a light emitting phase; wherein the compensation transistor is an oxide transistor, and the driving transistor is a low temperature poly-silicon transistor, wherein the light emitting control module comprises: a control unit and a gating unit; the control unit is coupled to a second reset terminal, a second scanning terminal and the gating unit, and configured to transmit a second level signal provided by the second reset terminal to the gating unit in response to the second level signal in the reset phase; to transmit a second level signal provided by the second scanning terminal to the gating unit in response to the second level signal in the data writing phase; and to transmit a first level signal provided by the second reset terminal to the gating unit in response to the first level signal in the light emitting phase; the gating unit is configured to enable the first power terminal and the first electrode of the driving transistor to be electrically connected to each other and enable the second electrode of the driving transistor and the light emitting device to be electrically connected to each other under control of the first level signal; and to disconnect the first power terminal from the first electrode of the driving transistor and disconnect the second electrode of the driving transistor from the light emitting device under control of the second level signal, wherein the control unit comprises: a first control transistor, a second control transistor, a third control transistor, and a fourth control transistor; a gate electrode and a first electrode of the first control transistor are both coupled to the second scanning terminal, and a second electrode of the first control transistor is coupled to the gating unit; a gate electrode and a first electrode of the second control transistor are both coupled to the second reset terminal, and a second electrode of the second control transistor is coupled to the gating unit; a gate electrode and a first electrode of the third control transistor are both coupled to the second scanning terminal, and a second electrode of the third control transistor is coupled to a first electrode of the fourth control transistor; and a gate electrode of the fourth control transistor is coupled to the second reset terminal, and a second electrode of the fourth control transistor is coupled to the gating unit, wherein the gating unit comprises: a first gating transistor and a second gating transistor, a gate electrode of the first gating transistor is coupled to the control unit, a first electrode of the first gating transistor is coupled to the first power terminal, and a second electrode of the first gating transistor is coupled to the first electrode of the driving transistor; a gate electrode of the second gating transistor is coupled to the control unit, a first electrode of the second gating transistor is coupled to the second electrode of the driving transistor, and a second electrode of the second gating transistor is coupled to the light emitting device, the driving method comprises steps of:

in the reset phase, transmitting, by the first reset module, a signal from the initialization voltage terminal to the gate electrode of the driving transistor, so as to control the driving transistor to be turned on; by the light emitting control module, disconnecting the first power terminal from the first electrode of the driving transistor and disconnecting the second electrode of the driving transistor from the light emitting device;

in the data writing phase, writing, by the data writing module, a data signal from the data writing terminal into the first electrode of the driving transistor; enabling, by the compensation transistor, the second electrode and the gate electrode of the driving transistor to be electrically connected to each other; by the light emitting control module, disconnecting the first power terminal from the first electrode of the driving transistor and disconnecting the second electrode of the driving transistor from the light emitting device; and in the light emitting phase, by the light emitting control module, enabling the first power terminal and the first electrode of the driving transistor to be electrically connected to each other and enabling the second electrode of the driving transistor and the light emitting device to be electrically connected to each other, and the driving method further comprises steps of:

in the reset phase, providing the first level signal to the first reset terminal and the second scanning terminal, and providing the second level signal to the first scanning terminal and the second reset terminal;

in the data writing phase, providing the second level signal to the first reset terminal and the second scanning terminal, and providing the first level signal to the first scanning terminal and the second reset terminal; and in the light emitting phase, providing the second level signal to the first reset terminal and the first scanning terminal, and providing the first level signal to the second reset terminal and the second scanning terminal.

* * * * *